US007415227B2

(12) United States Patent
Shimura et al.

(10) Patent No.: US 7,415,227 B2
(45) Date of Patent: Aug. 19, 2008

(54) IMAGE FORMING APPARATUS

(75) Inventors: Noriaki Shimura, Nagano (JP); Yujiro Nomura, Nagano (JP); Kuniaki Tanaka, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 301 days.

(21) Appl. No.: 11/314,182

(22) Filed: Dec. 20, 2005

(65) Prior Publication Data

US 2006/0153592 A1 Jul. 13, 2006

(30) Foreign Application Priority Data

Dec. 20, 2004 (JP) ..... P2004-367629
Dec. 20, 2004 (JP) ..... P2004-367630
Dec. 20, 2004 (JP) ..... P2004-367631

(51) Int. Cl.
*G03G 15/00* (2006.01)

(52) U.S. Cl. ..... 399/167

(58) Field of Classification Search ..... 399/167, 399/299–302

See application file for complete search history.

(56) References Cited

U.S. PATENT DOCUMENTS 6,173,141 B1 1/2001 Sakagami et al.
6,285,847 B1 9/2001 Tanizaki et al.
6,453,139 B2 * 9/2002 Sasame et al. ..... 399/167
7,206,537 B2 * 4/2007 Funamoto et al. ..... 399/167

FOREIGN PATENT DOCUMENTS

JP 10288898 A * 10/1998
JP 2000-206760 7/2000
JP 2000-276030 10/2000
JP 2001-134108 5/2001
JP 2001-272834 10/2001
JP 2003-035984 2/2003
JP 2003-131464 5/2003
JP 2007155891 A * 6/2007

* cited by examiner

*Primary Examiner*—David M Gray
*Assistant Examiner*—Erika J. Villaluna
(74) *Attorney, Agent, or Firm*—Hogan & Hartson LLP

(57) ABSTRACT

A color image forming apparatus, comprising: a plurality of image forming stations, each including a photo conductor on which an electrostatic latent image is formed, a developing member which develops the latent image as a visible toner image, and a single motor pinion which drives both of the photo conductor and the developing member, and a transfer belt, onto which the toner image is transferred, and which is driven by the single motor pinion of a first one of the image forming stations.

13 Claims, 7 Drawing Sheets

IMAGE FORMING APPARATUS

BACKGROUND OF THE INVENTION

1. Technical Field of the Invention

The present invention relates to a tandem type color image forming apparatus for forming a color image by providing image forming stations arranged with charging means, image writing means and developing means at a surrounding of an image carrier for respective colors along a transfer belt and passing the transfer belt through the respective image forming stations.

2. Description of the Related Art

In a related art, according to an image forming apparatus using an electronic photography technology, a photo conductor constituting an image carrier is charged by charging means, a latent image is formed by irradiating light in accordance with image information onto the charged photo conductor, the latent image is developed by developing means and the developed toner image is transferred onto a record medium to form an image.

According to the image forming apparatus using electronic photography, when the apparatus is used for a long period of time, it is necessary to interchange a photosensitive drum, replenish or interchange a processing agent, adjust, clean, interchange others (charger, cleaner vessel or the like) and such maintenance operation is in fact difficult for other than a service man having specialized knowledge.

Hence, according to an image forming apparatus using an electronic photography image forming process, there is adopted a process cartridge system for forming an electronic photography photo conductor and processing means operated to the electronic photography photo conductor integrally into a cartridge, and making the cartridge attachable and detachable to and from a main body of the image forming apparatus. According to the process cartridge system, maintenance of the apparatus can be carried out by a user per se without depending on a service man and therefore, the operability can significantly promoted. Therefore, the process cartridge system is widely used in the image forming apparatus.

In a related art, there is a color image forming apparatus of a tandem type aligning a plurality of photosensitive drums in one raw. According thereto, while carrying to transport a transfer member by an electrostatic transfer belt tensioningly hung by a plurality of rollers, by 4 pieces of photosensitive drums arranged along a path of transporting the transfer member, toner images comprising yellow, magenta, cyan, black are successively transferred onto a sheet and a color image is formed by overlapping respective colors (see, JP-A-2000-276030).

Attention is attracted to the constitution in recent years since printing can be carried out at high speed. However, since respective colors are formed by 4 pieces of the photosensitive drums, in comparison with a color image forming apparatus having a constitution of overlapping colors on a single photosensitive drum by way of four of transport paths for respective colors, with regard to rotational driving of the photosensitive drums, further accuracy is requested. Further, in such a kind of apparatus, maintenance is made to be easy to be carried out by unitizing an image forming mechanism to constitute a process cartridge and constituting the process cartridge attachable and detachable to and from a main body of the image forming apparatus.

According to the image forming apparatus, in order to attach and detach the process cartridge, it is necessary to cut to separate an image carrier and a drive transmitting mechanism and there is a concern of failing in forming an image and destructing a part when the process cartridge is not correctly engaged therewith in reinserting the process cartridge. Therefore, an easiness of attaching and detaching the cartridge to and from the apparatus main body and a certainty in an engaging state thereof are requested.

However, in the case of the cartridge of a photo conductor and developer integral type of the related art, a drive source of the photo conductor requesting a rotational accuracy is constituted by a system separately from a system of driving the developer or the cleaning means, drive forces of respective driven members are transmitted by coupling means and therefore, there poses a problem that a drive force transmitting mechanism becomes complicated and there is constructed a complicated constitution in attaching and detaching the drive force transmitting means in attaching or detaching the cartridge owing to a problem of phase matching or the like.

According to the image forming apparatus of a related art, driven motors are individually provided respectively for driven members for driving a photo conductor, for driving developing means, for driving a transcribing roller and so on. When the drive motors are arranged for the respective driven members in this way, the apparatus becomes large-sized to constitute a factor of an increase in cost, and therefore, there is also carried out a system of driving a plurality of driven members by a single drive motor. JP-A-2003-35984 discloses an image forming apparatus in which a plurality of photo conductors are driven by a singe drive motor and which is connected by a plurality of drive gears of the photo conductors and a drive gear of a developing roller. Further, JP-A-2003-131464 discloses an image forming apparatus in which a photo conductor and a developing apparatus are driven by branching a drive force of a single drive motor and which is provided with a clutch for switching to transmit a drive force of a fixing apparatus.

However, according to a constitution disclosed in JP-A-2003-35984, there poses a problem that a number of idle gears is large, which effects a significant influence on an image quality from a view point of an accuracy of the gear, further, since driving of a developer is branched from a middle of driving a photo conductor, respective loads thereof effect influences on each other. Further, according to a constitution disclosed in JP-A-2003-131464, driving of the fixing apparatus is switched by using the clutch means and therefore, there poses a problem that a complicated structure is constituted.

Further, according to a color image forming apparatus, a full color image is formed by overlapping toner images of respective colors and therefore, in order to promote an image quality, it is necessary to adjust a condition of driving the respective image forming stations.

SUMMARY OF THE INVENTION

It is a first object of the invention to provide a tandem type color image forming apparatus resolving the above-described problems, simplifying a constitution of a drive force transmitting mechanism, facilitating to attach and detach a cartridge to and from an apparatus main body and achieving a color image having a high image quality.

It is a second object of the invention to provide an image forming apparatus resolving the above-described problem, capable of reducing a group of wasteful idle gears, influences of driven members to each other being made to be as small as possible, and having a compact structure including a drive transmitting mechanism facilitated to attach and detach expendable items in an axial direction.

It is a third object of the invention to provide a tandem type color image forming apparatus having a drive transmitting mechanism resolving the above-described problem, capable of reducing a group of wasteful idle gears, making influences of loads on respective driven members as small as possible and facilitating to attach and detach expendable items in an axial direction, and capable of forming a full color image having a high quality without color shift by making conditions of driving the respective image forming stations coincide with each other.

The at least one of the above objects are solved by the following invention:

The first invention is characterized in that in an image forming apparatus, in an image forming apparatus for driving a photo conductor, a transfer belt, a developer by a single drive source, driven gears of the photo conductor and the transfer belt are coaxially formed to be transmitted from a motor pinion, and a driven gear of the developer is formed at a separate shaft to be transmitted from the motor pinion.

The second invention is characterized in that a drive force of the photo conductor is transmitted by way of a coupling, a drive force of the developer is transmitted by gear delivery, and the driven gear of the developer is made to be slidable in an axial direction in the image forming apparatus of the first invention.

The third invention is characterized in that the photo conductor and the developer are constituted by an integral cartridge in the image forming apparatus of the first or the second invention.

The fourth invention is characterized in that the coaxial driven gears of the photo conductor and the transfer belt and the driven gear of the developer at a separate shaft are linearly arranged by interposing the motor pinion.

In the image forming apparatus for driving the photo conductor, the transfer belt, the developer by the single drive source, by the constitution of coaxially forming the driven gears of the photo conductor and the transfer belt to be transmitted from the motor pinion and forming the driven gear of the developer at the separate shaft to be transmitted from the motor pinion, since the driving is branched by the motor pinion, the influences of the loads to the driven members can be made to be as small as possible, the driven gears of the photo conductor and the transfer belt are coaxially arranged and therefore, the wasteful idle gears can be reduced. Further, by arranging the driven gear of the developer in which the load is varied by a variation in the toner amount at the separate shaft, the influence of the variation in the load can be reduced.

By the constitution of transmitting the drive force of the photo conductor by way of the coupling and transmitting the drive force of the developer by gear delivery and making the drive gear of the developer slidable in the axial direction, attachment and detachment to and from the apparatus main body in interchanging expendable items are facilitated.

By constituting the photo conductor and the developer by the integral cartridge, attachment and detachment to and from the apparatus main body are facilitated.

By the constitution of linearly arranging the coaxial driven gears of the photo conductor and the transfer belt and the drive gear of the developer at the separate shaft by interposing the motor pinion, fall down of the motor pinion can be prevented.

In order to resolve the above-described problems, the fifth invention is characterized in that in a tandem type color image forming apparatus for forming a color image, photo conductors and developers of respective image forming stations are respectively driven by single drive sources, the drive source of one of the image forming stations is constituted to transmit a transfer belt, and the drive sources of the other image forming stations are driven by constituting a reference mark by a registration mark formed by the photo conductor driven by the drive source for driving the transfer belt.

The sixth invention is characterized in that the photo conductor and the transfer belt are coaxially arranged with driven gears to be transmitted from a motor pinion, and a driven gear of the developer is arranged at a separate shaft to be transmitted from the motor pinion at the drive source of driving the transfer belt in the tandem type color image forming apparatus of the first invention.

The seventh invention is characterized in that a drive force of the photo conductor is transmitted by way of a coupling and a drive force of the developer is transmitted by gear delivery in the tandem type color image forming apparatus of the first or the second invention.

The eighth invention is characterized in that the coaxial driven gears of the photo conductor and the transfer belt and the driven gear of the developer at the separate shaft are linearly arranged by interposing the motor pinion in the tandem type color image forming apparatus of any one of the first through the fourth inventions.

The ninth invention is characterized in that the drive source for driving the transfer belt is constituted by the image forming station for forming an image of a monochromatic mode in the tandem type color image forming apparatus of any one of the first through the fourth inventions.

The tenth invention is characterized in that the drive source for driving the transfer belt is constituted by the image forming station for forming an image of a black color in the tandem type color image forming apparatus according to any one of the first through the fourth inventions.

According to the tandem type color image forming apparatus for forming the color image, by the constitution of driving the photo conductors and the developers of the respective image forming stations respectively by the single drive sources and transmitting the drive source of one of the image forming stations to drive the transfer belt and driving the drive sources of the other image forming stations by constituting the reference mark by the registration mark formed by the photo conductor driven by the drive source for driving the transfer belt, the photo conductor and the transfer belt are driven by the drive source having the drive load larger than those of the other image forming station and therefore, a color image having a high quality without color shift can be formed by driving the drive source of the other image forming station by constituting the reference by the registration mark formed by the drive source.

By the constitution of coaxially arranging the driven gears of the photo conductor and the transfer belt to be transmitted from the motor pinion and arranging the driven gear of the developer at the other shaft to be transmitted from the motor pinion at the drive source for driving the transfer belt, a space of arranging the gears can be saved, the developing drive gear with the large variation of the load is arranged at the separate shaft and therefore, the influence of the variation of the load to the other driven member can be reduced.

By the constitution of transmitting the drive force of the photo conductor by way of the coupling and transmitting the drive force of the developer by gear delivery and making the driven gear of the developer slidable in the axial direction, the drive force receiving portions can centrally be arranged and attachment and detachment in interchanging expendable items are facilitated.

By the constitution of linearly arranging the coaxial driven gears of the photo conductor and the transfer belt and the driven gear of the developer at the separate shaft by interposing the motor pinion, fall down of the motor pinion is prevented.

By the constitution of the image forming station for forming an image of the monochromatic mode by the drive source for driving the transfer belt, the drive source can be arranged at the most downstream one of the plurality of image forming stations since a frequency of using the drive source is the highest and arrangement of the gears can be simplified from a positional relationship with the drive roller of the transcribing roller.

By the constitution of constituting the drive source for driving the transfer belt by the image forming station for forming the image of the black color, there is a high possibility of selecting the monochromatic mode and therefore, the frequency of using the drive source is the highest and therefore, the drive source can be arranged at the most downstream side of the plurality of image forming stations, and arrangement of gears can be simplified from the positional relationship with the drive roller of the transcribing roller.

In order to resolve the above-described problem, the eleventh invention is characterized in a color image forming apparatus of a tandem type for forming a color image, wherein respective image forming stations are constituted by cartridges of a photo conductor/developer integral type, a photo conductor and a developer are constituted to receive a drive force from a single motor pinion, a driven gear of the photo conductor is made to remain in an apparatus main body, the driven gear of the photo conductor and the photo conductor in the cartridge are connected by coupling, and a driven gear of the developer in the cartridge and a driven gear of the developer in the apparatus main body are brought in mesh with each other.

The twelfth invention is characterized in that the driven gear of the photo conductor and the driven gear of the developer are linearly arranged by interposing the motor pinion in the tandem type color image forming apparatus of the first invention.

The thirteenth invention is characterized in that the driven gear of the developer in the apparatus main body is made to be slidable in an axial direction in the tandem type color image forming apparatus of the first or the second invention.

The fourteenth invention is characterized in that the photo conductor is made to be cleanerless in the tandem type color image forming apparatus of any one of the first through the third inventions.

By constituting the color image forming apparatus of the tandem type for forming the color image such that the respective image forming stations are constituted by the cartridges of the photo conductor/developer integral type, the photo conductor and developer are constituted to receive the drive force from the single motor pinion, the driven gear of the photo conductor is made to remain in the apparatus main body, the driven gear of the photo conductor and the photo conductor in the cartridge are connected by the coupling, the driven gear of the developer in the cartridge and the driven gear of the developer in the apparatus main body are brought in mesh with each other, portions of receiving the drive forces can centrally be arranged, the developer is driven by delivery of the gears by only matching the phase of the coupling for driving the photo conductor and therefore, attachment and detachment to and from the apparatus main body of the cartridge are facilitated.

By the constitution of linearly arranging the driven gear of the photo conductor and the driven gear of the developer by interposing the motor pinion by interposing the motor pinion, there can be reduced the influence on the variation in the load from the driven gear of the developer having a large variation of the load to the driven gear of the photo conductor and fall down of the motor pinion can be prevented.

By the constitution of making the driven gear of the developer in the apparatus main body slidable in the axial direction, attachment and detachment of the cartridge are facilitated.

By the constitution of making the photo conductor cleanerless, the cartridge can be downsized.

DETAILED DESCRIPTION OF THE INVENTION

First Embodiment

Figure 1:
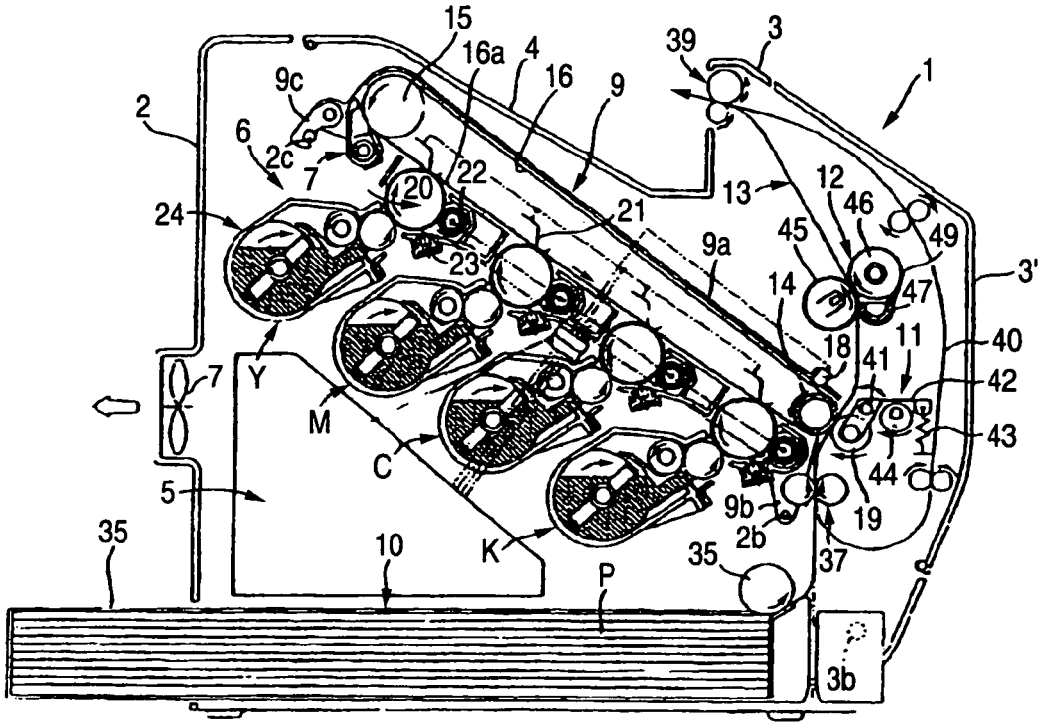
FIG. 1 is a view showing an embodiment of a color image forming apparatus according to the invention.
Figure 2:
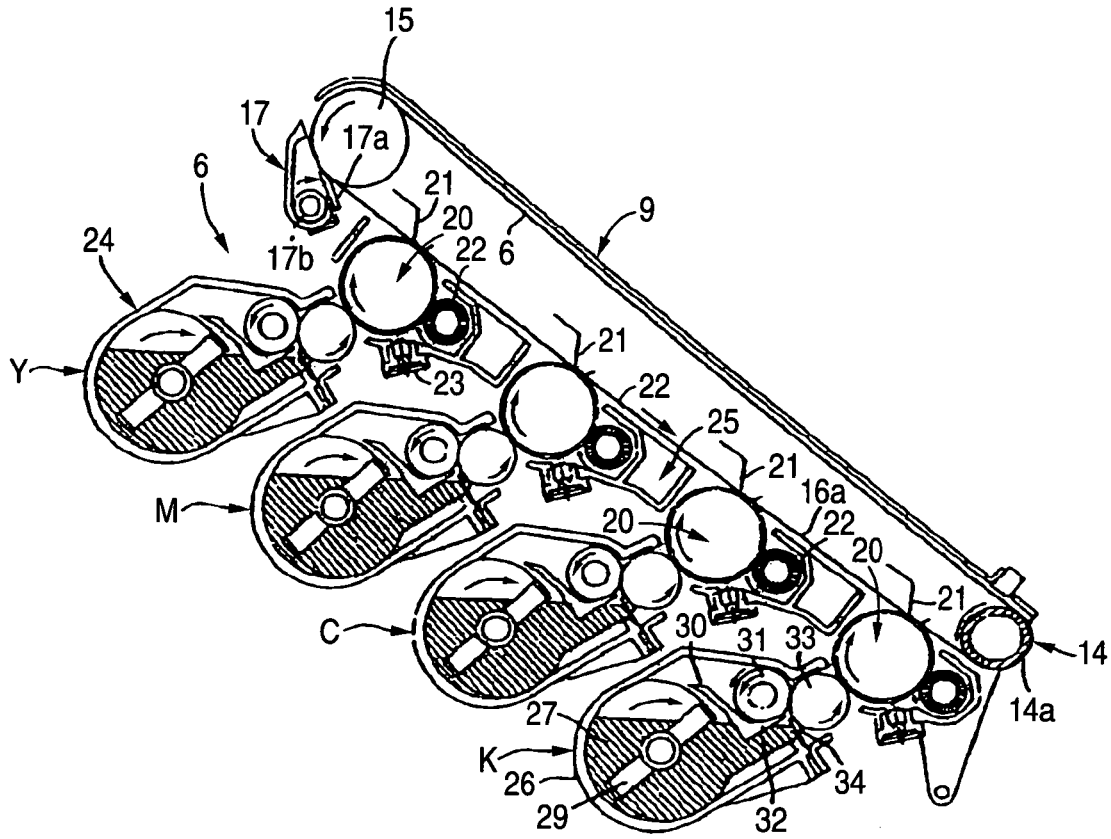
FIG. 2 is a view showing a partial constitution of the embodiment of the image forming apparatus according to the invention.

A first embodiment of the invention will be explained in reference to the drawings. FIG. 1 is a view showing a total constitution of an embodiment of a color image forming apparatus according to the invention. FIG. 2 is a view showing a partial constitution of the embodiment of the image forming apparatus according to the invention. Further, in the following explanation, there is a case of omitting the explanation by attaching the same numerals among the respective drawings. The embodiment is an example of using an intermediate transfer belt as a transfer belt.

In FIG. 1 and FIG. 2, an image forming apparatus 1 of the embodiment is provided with a housing main body 2, inside of the housing main body 2 is arranged with an image forming unit 6, a transfer belt unit 9, a sheet feeding unit 10, further, arranged with a secondarily transcribing unit 11, a fusing unit 12, and record medium transporting means 13. Expendable items in the image forming unit 6 and the sheet feeding unit 10 are constructed by a constitution attachable and detachable to and from the main body, in that case, there is constructed a constitution capable of being repaired or interchanged by being detached therefrom including the transfer belt unit 9.

The transfer belt unit 9 is provided with a drive roller 14, a driven roller 15 arranged on a skewed upper side of the drive roller 14, an intermediate transfer belt 16 driven to circulate in an illustrated arrow mark direction by being tensioningly hung between two pieces of the rollers 14, 15 and cleaning means 17, and the driven roller 15 and the intermediate transfer belt 16 are arranged in a direction of being inclined to a left side of the drawing relative to the drive roller 14. Thereby, a belt face **16*a* directing a belt transporting direction downward in driving the intermediate transfer belt 16 is made to be disposed downward. According to the embodiment, the belt face 16*a* is a belt tensioning face (face pulled by the drive roller 14**) in driving the belt.

Further, primarily transfer members 21 are brought into contact with a back face of the belt face **16*a* directed downward in the direction of transporting the intermediate transfer belt 16 by elastic forces opposedly to image carriers 20 of respective image forming stations Y, M, C, K, mentioned later, and the primarily transfer member 21 may be constituted by a shape of a leaf spring as shown by the drawing or a shape of a roller. The primarily transfer member 21** is applied with a transcribing bias.

A support frame 9*a* of the transfer belt unit 9 is installed with a test pattern sensor 18 proximately to the drive roller 14. The test pattern sensor 18 is a sensor for positioning respective color toner images on the intermediate transfer belt 16, detecting darknesses of the respective color toner images and correcting a color shift or an image darkness of each color image.

The image forming unit 6 is provided with image forming stations Y (for yellow), M (for magenta), C (for cyan), K (for black) for forming a plurality (four according to the embodiment) of different colors of images, and each of the image forming stations Y, M, C, K includes the image carrier 20 comprising a photosensitive drum, charging means 22, image writing means 23 and developing means 24 arranged at a surrounding of the image carrier 20, respectively. Further, the developing means 24 is attached with a drawing numeral only for the image forming station K and drawing numerals are omitted for other image forming stations since constitutions thereof stays the same. Further, an order of arranging the respective image forming stations Y, M, C, K is arbitrary.

Further, the image carriers 20 of the respective image forming stations Y, M, C, K are made to be brought into contact with the belt face 16*a* directed downward in the direction of transporting the intermediate transfer belt 16, as a result, also the respective image forming stations Y, M, C, K are arranged in the direction of being inclined to the left side of the drawing relative to the drive roller 14. The image carrier 20 is driven to rotate in the direction of transporting the intermediate transfer belt 16 as shown by an illustrated arrow mark.

According to the embodiment, a toner storing vessel 26 is arranged to be inclined in a skewed lower direction in view of a relationship in which the respective image stations Y, M, C, K are arranged in a skewed direction and the image carriers 20 are brought into contact with the belt face 16*a* directed downward in the direction of the intermediate transfer belt 16.

The developing means 24 is constituted by the toner storing vessel 26 for storing a toner (hatched portion of the drawing), a toner storing portion 27 formed at inside of the toner storing vessel 26, a toner stirring member 29 arranged at inside of the toner storing portion 27, a partitioning member 30 formed to partition at an upper portion of the toner storing portion 27, a toner supply roller 31 arranged at an upper side of the partitioning member 30, a blade 32 provided at the partitioning member 30 and brought into contact with the toner supply roller 31, a developing roller 33 arranged to be brought into contact with the toner supply roller 31 and the image carrier 20, and a rectifying blade 34 brought into contact with the developing roller 33. The toner is a negatively charged toner comprising one component nonmagnetic toner. The toner supply roller 31 and the developing roller 33 are rotated in the same direction.

The image carrier 20 is rotated in the direction of transporting the intermediate transfer belt 16, the developing roller 33 and the supply roller 31 are driven to rotate in a direction reverse to the direction of rotating the image carrier 20 as shown by illustrated arrow marks, on the other hand, the stirring member 29 is driven to rotate in a direction reverse to the direction of rotating the supply roller 31. The toner stirred and conveyed up by the stirring member 29 is supplied to the toner supply roller 31 along an upper face of the partitioning member 30, and the supplied toner is abraised with the blade 32 and is supplied to a surface of the developing roller 33 by a mechanical adhering force to recessed and projected portions of a surface of the supply roller 31 and an adhering force by a friction charge force. The toner supplied to the developing roller 33 is rectified to a predetermined thickness of a layer thickness by the rectifying blade 34, the toner layer formed into a thin layer is transported to the image carrier 20 to develop a latent image portion of the image carrier 20 at a nip portion constituted by bringing the developing roller 33 and the image carrier 20 into contact with each other and a vicinity thereof.

The sheet feeding unit 10 is provided with a sheet feeding portion comprising a sheet feeding cassette 35 to which record media P are laminated to be held thereby, and a pickup roller 36 for feeding the record media P from the sheet feeding cassette 35 sheet by sheet. Inside of a first opening/closing member 3 is provided with a registration roller pair 37 for rectifying timings of feeding sheets to the secondarily transcribing portion, the secondarily transcribing unit 11 as secondarily transcribing means brought into press contact with the drive roller 14 and the intermediate transfer belt 16, the fusing unit 12, the record medium transporting means 13, a sheet discharge roller pair 39, and a both face printing transport path 40.

The secondarily transcribing unit 11 is provided with a pivoting lever 42 axially supported pivotably by a fixed shaft 41, a secondarily transcribing roller 19 pivotably provided at one end of the pivoting lever 42, and a spring 43 arranged between other end of the pivoting lever 42 and the first opening/closing member 3, normally, the secondarily transcribing roller 19 is moved in an illustrated arrow mark direction by being urged by the spring 43, and made to be able to be pressed to the intermediate transfer belt 16 and the drive roller 14. An eccentric cam 44 is provided on a side of the spring 43 of the pivoting lever 42, and the pivoting lever 42, the spring 43 and the eccentric cam 44 constitute means for being brought into contact with and separated from the secondarily transcribing roller 19. Further, by pivoting the eccentric cam 44, the pivoting lever 42 is pivoted against the spring 43 to separate the secondarily transcribing roller 19 from the intermediate transfer belt 16.

The fusing unit 12 includes a heating roller 45 including a heat generating member of a halogen heater or the like and made to be rotatable, a pressing roller 46 for pressing to urge the heating roller 45, a belt tensioningly hanging member 47 pivotably arranged at the pressing roller 46, and a heat resistant belt 49 tensioningly hung between the pressing roller 45 and the belt tensioningly hanging member 47, and a color image secondarily transferred onto the record medium is fixed to the record medium at a predetermined temperature by a nip portion formed by the heating roller 45 and the heat resistant belt 49. According to the embodiment, the fusing unit 12 can be arranged at a space formed on a skewed upper side of the intermediate transfer belt 16, in other words, a space on a side opposed to the image forming unit 6 relative to the intermediate transfer belt 16, transfer of heat to an electric equipment box, the image forming unit 6 and the intermediate transfer belt 16 can be reduced, and a frequency of operating to correct color shifts for respective colors can be reduced.

Figure 3:
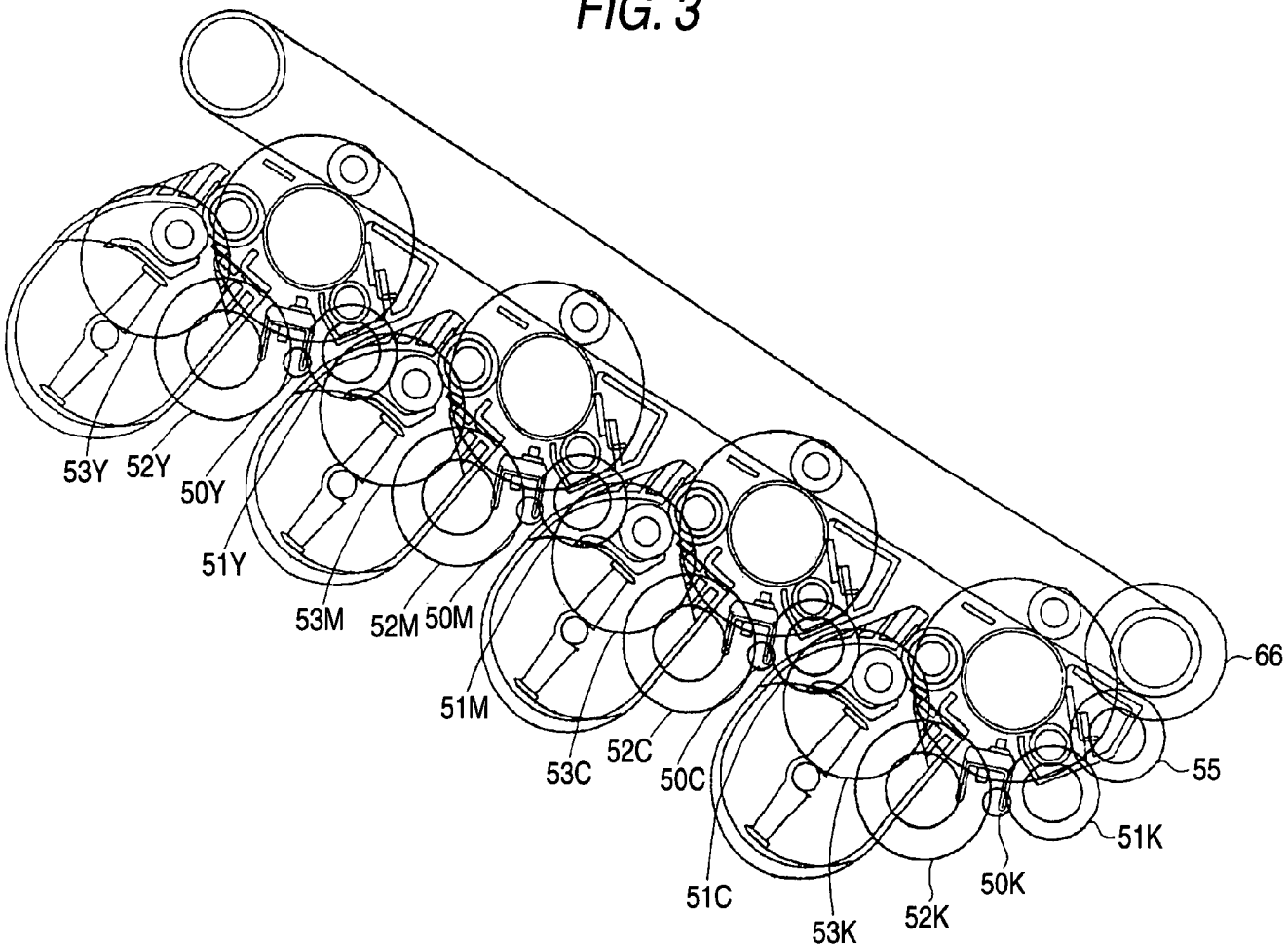
FIG. 3 is a plane view showing an arrangement of a train wheel of a drive transmitting mechanism

FIG. 3 is a plane view showing an arrangement of a train wheel of a drive transmitting mechanism of the image forming unit 6 and the transfer belt unit 9. The respective image forming stations Y, M, C, K of the image forming unit 8 are individually arranged with a first through a fourth drive motor. Motor pinions 50Y, 50M, 50C, 50K of the respective drive motors are brought in mesh with photo conductor driving idle gears 51Y through 51K and developer driving idle gears 52Y through 52K.

According to the train wheel arrangement of the respective image forming stations Y, M, C, K, the respective photo conductor driving idle gears 51Y, 51M, 51C, 51K and the respective developer driving first idle gears 52Y, 52M, 52C, 52K are arranged on linear lines by interposing the respective motor pinions 50Y, 50M, 50C, 50K. By constituting the train wheel arrangement by a linear shape, there can be reduced an influence on a driven gear of the photo conductor requesting a rotational accuracy by a variation in a load by a driven gear of the developer having a large variation in a load by a variation in a toner amount, further, fall down of the motor pinion can be prevented.

The respective developer driving first idle gears 52Y, 52M, 52C, 52K are brought in mesh with respective developer driving second idle gears 53Y, 53M, 53C, 53K. According to the image forming stations Y, M, C, K, the photo conductor driving first idle gears 51Y, 51M, 51C, 51K and the developer driving first idle gears 52Y, 52M, 52C, 52K are bifurcated from the respective motor pinions 50Y, 50M, 50C, 50K.

Figure 4:
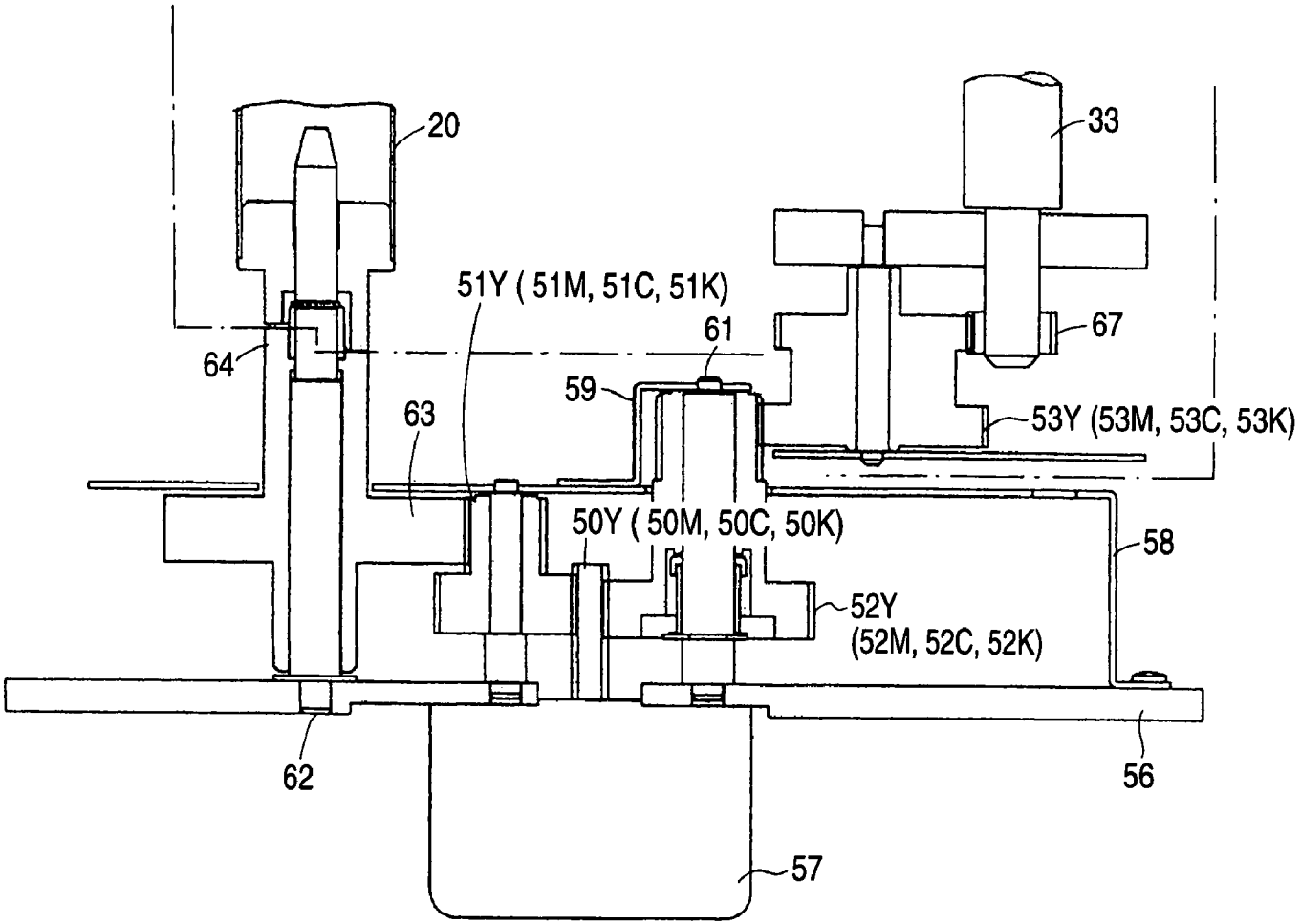
FIG. 4 is a sectional view of the bifurcated drive transmitting mechanism of the image forming station.

FIG. 4 is a sectional view of the bifurcated drive transmitting mechanism of the image forming stations Y, M, C, K. According to the image forming apparatus of the invention, a cartridge is shown by a portion of each of the image forming stations surrounded by a one-dotted chain line in a cartridge system of a photo conductor and developer integral type. The cartridge can be downsized by making the photo conductor 20 cleanerless. A drive motor 57 is attached to a lower face of a drive board 56 of the apparatus main body. A first train wheel support plate 58 is attached to an upper face of the drive board 56, and a second train wheel support plate 59 is attached on the first train wheel support plate 58. The motor pinion 50Y, 50M, 50C, 50K of the drive motor 57 is projected from an upper face of the drive board 56. The photo conductor driving idle gear 51Y, 51M, 51C, 51K is arranged rotatably at upper and lower sides of a shaft 60 both ends of which are supported by the drive board 56 and the first train wheel support plate 58. The developer driving first idle gear 52Y, 52M, 52C, 52K is arranged at a shaft 61 both ends of which are supported by the drive board 56 and the second train wheel support plate 59 movably in an up and down direction and rotatably.

The developer driving first idle gear 52Y, 52M, 52C, 52K of the apparatus main body is brought in mesh with the developer driving second idle gear 53Y, 53M, 53C, 53K in the cartridge. The developer driving second idle gear 53Y, M, C, K is brought in mesh with a developer drive gear 67 to drive the developing roller 33.

The motor pinion 50Y, 50M, 50C, 50K is brought in mesh with the photo conductor driving idle gear 51Y, 51M, 51C, 51K. Further, the motor pinion 50Y, 50M, 50C, 50K is brought in mesh with the developer driving first idle gear 52Y, 52M, 52C at the separate shaft. A photo conductor gear 63 is rotatably arranged at a photo conductor gear shaft 62 one end of which is supported by a drive board 55. The photo conductor gear 63 is brought in mesh with the photo conductor driving idle gear 51Y, 51M, 51C, 51K. The photo conductor gear shaft 62 is extended to a height projected from an upper face of the first train wheel support plate 58, and a coupling portion 64 is integrally formed with an upper end of the photo conductor gear 63 rotatably arranged at the photo conductor gear shaft 62. The coupling portion 64 is engaged with a coupling portion formed at an end portion of the photo conductor 20 at inside of the cartridge to transmit a drive force.

By constituting one of a system of transmitting the drive force of the photo conductor 20 and the developing roller 33 in the cartridge from the apparatus main body by the coupling and constituting other thereof by gear delivery, the apparatus can be downsized and attachment and detachment of the cartridge are facilitated.

Second Embodiment

A second embodiment of the invention will be explained in reference to the drawings. The second embodiment is different from the first embodiment in the point that in the image forming station K, the motor pinion 50K is trifurcated into the photo conductor driving idle gear 51K and the transfer driving first idle gear 54 which are coaxial and the developer driving first idle gear 52K at the separate shaft. According to the second embodiment, a transfer driving first idle gear 54 (refer to FIG. 5) is arranged coaxially with the photo conductor driving idle gear 50K. The transfer driving first idle gear 54 is brought in mesh with a transfer driving second idle gear 55. The transfer driving second idle gear 55 is brought in mesh with a transfer driving gear 66 to drive the transfer driving roller 14. According to the image forming stations Y, M, C, the photosensitive driving first idle gears 51Y, 51M, 51C and the developer driving first idle gears 52Y, 52M, 52C are bifurcated from the respective motor pinions 50Y, 50M, 50C transfer.

Figure 5:
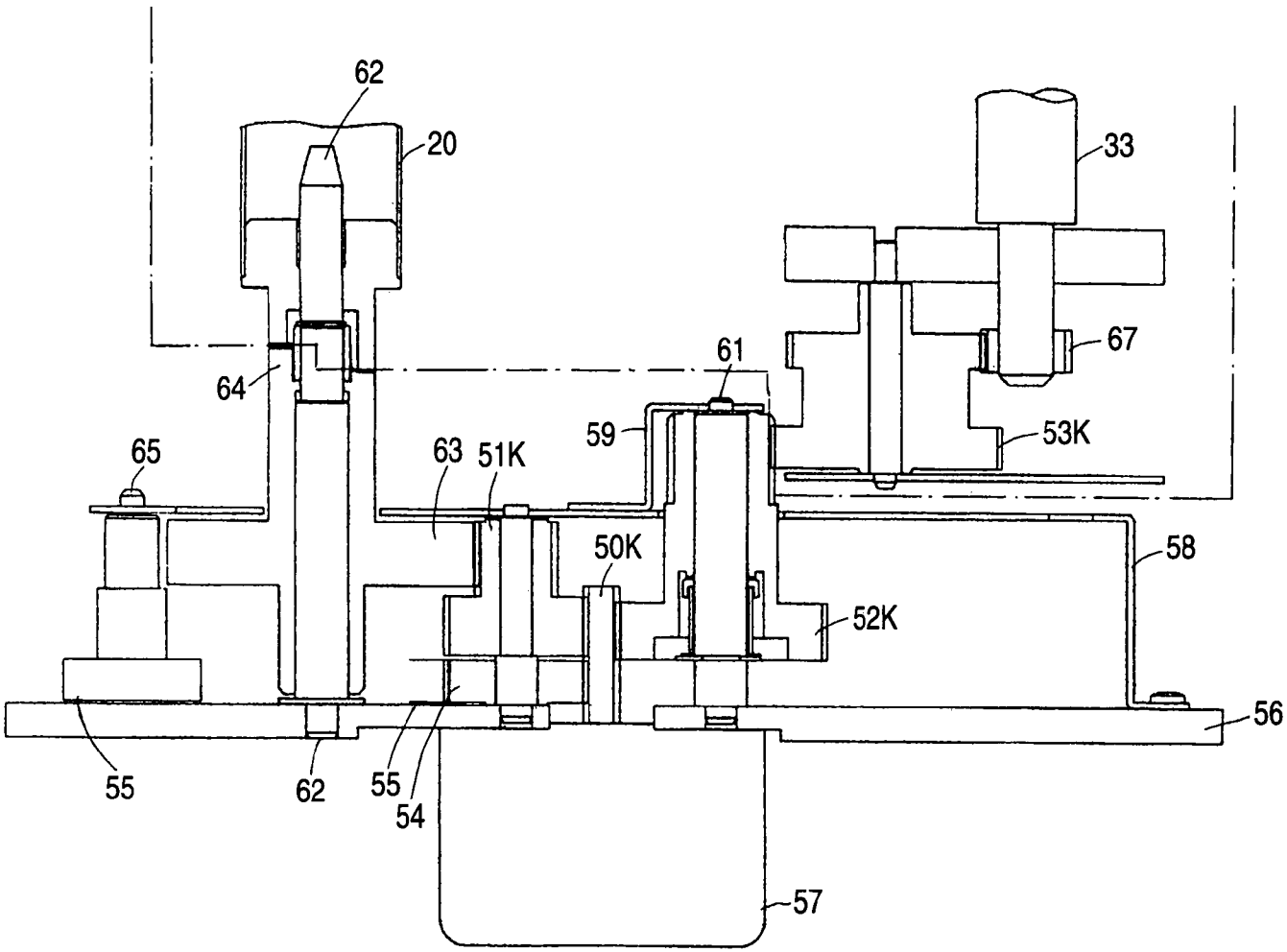
FIG. 5 is a sectional view of a drive transmission mechanism of the trifurcated image forming station.
Figure 6:
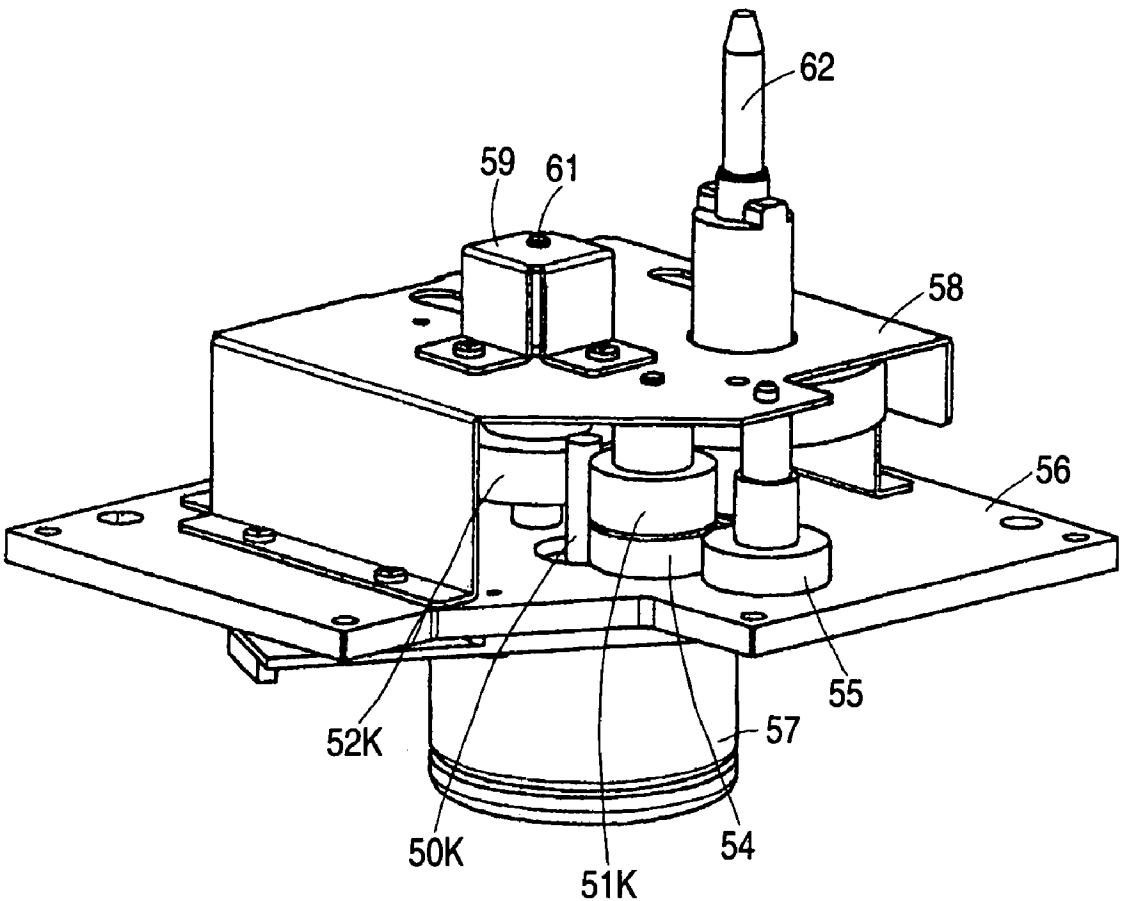
FIG. 6 is a perspective view of a drive transmitting mechanism in FIG. 5.

FIG. 5 is a sectional view of a drive transmission mechanism of the trifurcated image forming station K, and FIG. 6 is a perspective view of a drive transmitting mechanism on a side of the main body. A portion in FIG. 5 surrounded by a one-dotted chain line shows a photo conductor/developer integral cartridge, the cartridge is attachable and detachable to and from the apparatus main body. A lower face of a drive board 56 of the apparatus main body is attached with a drive motor 57 of the image forming station K. An upper face of the drive board 56 is attached with a first train wheel support plate 58, and a second train wheel support plate 59 is attached onto the first train wheel support plate 58. The motor pinion 50K of the drive motor 57 is projected from the upper face of the drive board 56. The photo conductor driving idle gear 51K and the transfer driving first idle gear 54 are rotatably arranged on upper and lower sides of a shaft 60 both ends of which are supported by the drive board 56 and the first train wheel support plate 58. The developer driving first idle gear 52K is arranged at a shaft 61 both ends of which are supported by the drive board 56 and the second train wheel support plate 59 by way of a spring 61 movably in an up and down direction and rotatably. The developer driving first idle gear 52K is brought in mesh with the developer driving second idle gear 53K in the cartridge, the developer driving second idle gear 53K is brought in mesh with a developer driving gear 67 to drive the developing roller 33. The motor pinion 50K is brought in mesh with the photo conductor driving idle gear 51K and the transfer driving first idle gear 54 which are coaxially arranged. Further, the motor pinion 50K is brought in mesh with the developer driving first idle gear 52K at the separate shaft. A photo conductor gear 63 is rotatably arranged at a photo conductor gear shaft 62 one end of which is supported by the drive board 56. The photo conductor gear 63 is brought in mesh with the photo conductor driving idle gear 51K. The photo conductor gear shaft 62 is extended up to a height of projecting from the upper face of the first train wheel support plate 58 and an upper end of the photo conductor gear 63 rotatably arranged at the photo conductor gear shaft 62 is integrally formed with a coupling portion 64. The coupling portion 64 is engaged with a coupling portion formed at an end portion of the photo conductor 20 at inside of the cartridge to transmit the drive force. Further, the transfer driving second idle gear 55 is rotatably arranged at the shaft 65 the both ends of which are supported by the drive board 56 and the first train wheel support plate 58. The transfer driving second idle gear 55 is brought in mesh with the transfer driving first idle gear 54. The transfer driving second idle gear 55 is brought in mesh with the transfer driving gear 66 to drive the transfer driving roller 14.

Figure 7:
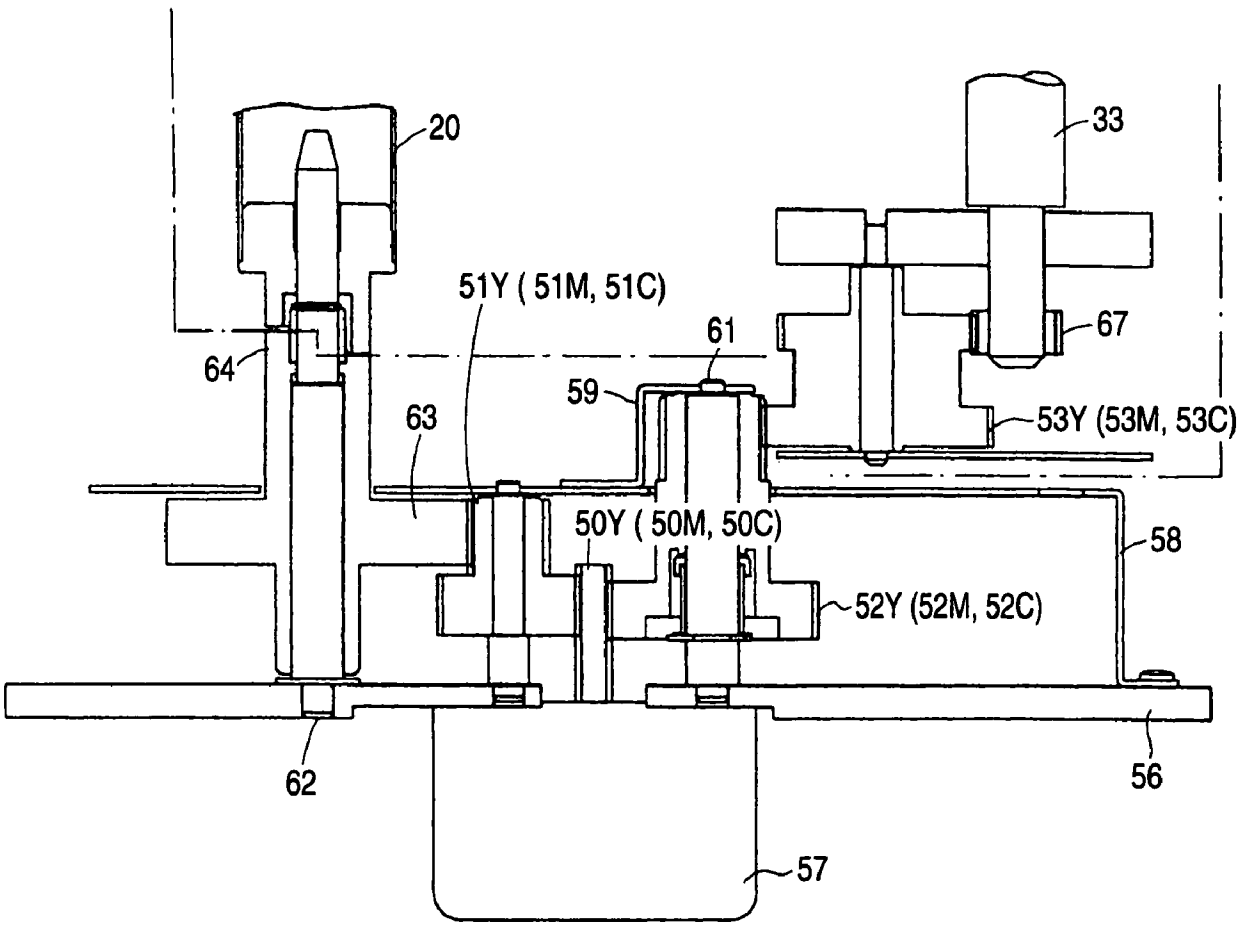
FIG. 7 is a sectional view of the bifurcated drive transmitting mechanism of the image forming station.

FIG. 7 is a sectional view of the drive transmission mechanism of the bifurcated image forming station Y, M, C. The drive motor 57 is attached to the lower face of the drive board 56 of the apparatus main body. The first train wheel support plate 58 is attached to the upper face of the drive board 56, and the second train wheel support plate 59 is attached onto the first train wheel support plate 58. The motor pinion 50Y, 50M, 50C of the drive motor 57 is projected from the upper face of the drive board 56. The photo conductor driving idle gear 51Y, 51M, 51C is rotatably arranged on upper and lower side of the shaft 60 the both ends of which are supported by the drive board 66 and the first train wheel support plate 57. The developer driving first idle gear 52Y, 52M, 52C is rotatably arranged at the shaft 61 the both ends of which are supported by the drive board 55 and the second train wheel support plate 58 by way of the spring 61 movably in up and down direction and rotatably. The developer driving first idle gear 52Y, 52M, 52C is brought in mesh with the developer driving second idle gear 53Y, 53M, 53C at inside of the cartridge, and the developer driving second idle gear 53Y, 53M, 53C is brought in mesh with the developer driving gear 67 to drive the developing roller 33. The motor pinion 50Y, 50M, 50C is brought in mesh with the photo conductor driving idle gear 51Y, 51M, 51C. Further, the motor pinion 50Y, 50M, 50C is brought in mesh with the developer driving first idle gear 52Y, 52M, 52C at the separate shaft. The photo conductor gear 63 is rotatably arranged at the photo conductor gear shaft 62 one end of which is supported by the drive board 55. The photo conductor gear 63 is brought in mesh with the photo conductor driving idle gear 51Y, 51M, 51C. The photo conductor gear shaft 62 is extended up to a height of projecting from the upper face of the first train wheel support plate 58 and the coupling portion 64 is integrally formed at the upper end of the photo conductor gear 63 rotatably arranged at the photo conductor gear shaft 62. The coupling portion 64 is engaged with a coupling portion formed at an end portion of the photo conductor 20 in the cartridge to transmit the drive force.

According to the tandem type color image forming apparatus of the invention, the image forming stations Y, M, C, K for forming the images of the respective colors of Y (yellow), M (magenta), C (cyan), K (black) are aligned along a direction of running the transfer belt, multiple images of respective colors are transferred to the transfer belt or the record medium transported by the transfer belt while shifting timings of forming the images at the respective image forming stations to provide the color image and therefore, when a speed of driving the drive sources of the respective image forming stations and a speed of driving the transfer belt are varied, positions of transcribing the images of the respective colors delicately differ to produce color shift and the high quality color image cannot be provided.

Therefore, registration marks are formed at respectives on the image carriers 20 of the respective image forming stations Y, M, C, K, the registration marks are transferred from the respective image carriers 20 to the intermediate transfer belt 16 to form the plurality of registration marks on the intermediate transfer belt 16, the positions of the plurality of formed registration marks are detected, and a registration control among the respective color images in forming the image is carried out based on detecting signals.

According to the Image forming apparatus of the invention, the drive source of any one of image forming station of the respective image forming stations Y, M, C, K drives the transfer belt 16 and therefore, the drive load of the drive source for driving the transfer belt becomes larger than those of the drive sources of the other image forming stations, as a result, the speed of rotating the image carrier 20 is retarded more than the speed of rotating the image carriers 20 driven by the other drive sources. As a result, a difference is produced between the positions of forming the respective registration marks and the registration control becomes complicated. In order to prevent the complication, according to the invention, by driving the drive sources of the other image forming stations by constituting the reference by the registration mark formed by the image carrier 20 of the image forming station for driving the transfer belt, the high quality color image having small color shift can be provided.

The image forming station for driving the transfer belt is preferably the image forming station for forming the image of the monochromatic mode. Because the image forming station of the monochromatic mode can be arranged on the most downstream side of the plurality of image forming stations since the frequency of using the image forming station is the highest and gears are easy to be arranged from the positional relationship with the drive roller of the transcribing roller.

The image forming station for driving the transfer belt is preferably the image forming station for forming the image of the black color. Because the image forming station of black color is provided with a high frequency of being used as the image forming station of the monochromatic mode.

What is claimed is:

1. A color image forming apparatus comprising:

a plurality of image forming stations, each including a photo conductor on which an electrostatic latent image is formed, a developing member which develops the latent image as a visible toner image, and a single motor pinion which drives both of the photo conductor and the developing member, and a transfer belt, onto which the toner image is transferred, and which is driven by the single motor pinion of a first one of the image forming stations, wherein each of the image forming stations includes a cartridge housing the photo conductor and the developing member; and the color image forming apparatus further comprises:

a first gear provided outside the cartridge and driven by the motor pinion, the first gear being connected to the photo conductor by coupling;

a second gear provided outside the cartridge and driven by the motor pinion;

a third gear provided inside the cartridge and adapted to drive the developing member, the third gear being connected to the second gear by gearing.

2. The color image forming apparatus according to claim 1, wherein the image forming apparatus further comprises a fourth gear provided outside the cartridge, driven by the motor pinion, and connected to the first gear, the motor pinion is disposed between the fourth gear and the second gear, and the fourth gear, the motor pinion, and the second gear are arranged linearly.

3. The color image forming apparatus according to claim 1, wherein the second gear is slidable in an. axial direction thereof.

4. The color image forming apparatus according to claim 1, wherein the photo conductor is cleanerless type photo conductor.

5. A color image forming apparatus comprising:

a plurality of image forming stations, each including a photo conductor on which an electrostatic latent image is formed, a developing member which develops the latent image as a visible toner image, and a single motor pinion which drives both of the photo conductor and the developing member, and a transfer belt, onto which the toner image is transferred, and which is driven by the single motor pinion of a first one of the image forming stations, wherein, in the first one of the image forming stations, a first gear, which is provided outside the cartridge, is driven by the motor pinion and connected to drive the developing member;

a second gear, which is provided outside the cartridge, is driven by the motor pinion and connected to drive the photo conductor;

a third gear, which is provided outside the cartridge, is driven by the motor pinion and adapted to drive the transfer belt; and wherein the first gear is formed at a first shaft and the second gear and the third gear are formed at a second shaft different from the first shaft.

6. The color image forming apparatus according to claim 5, wherein drive force of the photo conductor is transmitted by coupling, drive force of the developing member is transmitted by gearing, and the first gear is slidable in an axial direction thereof.

7. The color image forming apparatus according to claim 5, wherein each of the image forming stations includes a cartridge housing the photo conductor and the developing member.

8. The color image forming apparatus according to claim 5, wherein the motor pinion is disposed between the first gear and the second gear, and the first gear, the motor pinion and the second gear are arranged linearly.

9. A color image forming apparatus comprising:

a plurality of image forming stations, each including a photo conductor on which an electrostatic latent image is formed, a developing member which develops the latent image as a visible toner image, and a single motor pinion which drives both of the photo conductor and the developing member, and a transfer belt, onto which the toner image is transferred, and which is driven by the single motor pinion of a first one of the image forming stations, wherein the motor pinion of a second one of the image forming stations is driven based on a registration mark formed by the photo conductor of the first one of the image forming station, and wherein in the first one of the image forming stations, a first gear, which is provided outside the cartridge, is driven by the motor pinion and connected to drive the developing member;

a second gear, which is provided outside the cartridge, is driven by the motor pinion and connected to drive the photo conductor;

a third gear, which is provided outside the cartridge, is driven by the motor pinion and adapted to drive the transfer belt; and wherein the first gear is formed at a first shaft and a gear and the third gear are formed at a second shaft different from the first shaft.

10. The color image forming apparatus according to claim 9, wherein the motor pinion is disposed between the first gear and the second gear, and the first gear, the motor pinion and the second gear are arranged linearly.

11. A color image forming apparatus comprising:

a plurality of image forming stations, each including a photo conductor on which an electrostatic latent image is formed, a developing member which develops the latent image as a visible toner image, and a single motor pinion which drives both of the photo conductor and the developing member, and a transfer belt onto which the toner image is transferred, and which is driven by the single motor pinion of a first one of the image forming stations, wherein the motor pinion of a second one of the image forming stations is driven based on a registration mark formed by the photo conductor of the first one of the image forming station, and wherein drive force of the photo conductor is transmitted by coupling, drive force of the developing member is transmitted by gearing, and a gear is made to be slidable in an axial direction thereof.

12. A color image forming apparatus comprising:

a plurality of image forming stations, each including a photo conductor on which an electrostatic latent image is formed, a developing member which develops the latent image as a visible toner image, and a single motor pinion which drives both of the photo conductor and the developing member, and a transfer belt, onto which the toner image is transferred, and which is driven by the single motor pinion of a first one of the image forming stations, wherein the motor pinion of a second one of the image forming stations is driven based on a registration mark formed by the photo conductor of the first one of the image forming station, and wherein the first one of the image forming stations is used when the color image forming apparatus is operated in a monochromatic mode.

13. The color image forming apparatus according to claim 12, wherein the first one of the image forming stations is for forming an image of a black color.

* * * * *